US009352311B2

(12) United States Patent
Ritter et al.

(10) Patent No.: US 9,352,311 B2
(45) Date of Patent: May 31, 2016

(54) DEVICE WITH DISPLAY FOR REPEATED DOSING

(71) Applicant: Ritter GmbH, Schwabmünchen (DE)

(72) Inventors: Ralf Ritter, Untermeitingen (DE); Frank Ritter, Eppishausen (DE)

(73) Assignee: Ritter GmbH, Schwabmünchen (DE)

( * ) Notice: Subject to any disclaimer, the term of this patent is extended or adjusted under 35 U.S.C. 154(b) by 0 days.

(21) Appl. No.: 14/386,754

(22) PCT Filed: Feb. 26, 2013

(86) PCT No.: PCT/EP2013/053835
§ 371 (c)(1),
(2) Date: Sep. 19, 2014

(87) PCT Pub. No.: WO2013/117774
PCT Pub. Date: Aug. 15, 2013

(65) Prior Publication Data

US 2015/0050198 A1 Feb. 19, 2015

(30) Foreign Application Priority Data

Mar. 19, 2012 (DE) ..... 10 2012 102 292

(51) Int. Cl.
*B01L 3/02* (2006.01)

(52) U.S. Cl.
CPC ..... *B01L 3/0224* (2013.01); *B01L 3/0234* (2013.01); *B01L 2200/023* (2013.01); *B01L 2200/087* (2013.01); *B01L 2300/026* (2013.01)

(58) Field of Classification Search
USPC ..... 73/864.18, 864.01; 422/501, 922, 925
See application file for complete search history.

(56) References Cited

U.S. PATENT DOCUMENTS 5,104,624 A 4/1992 Labriola
5,320,810 A * 6/1994 Al-Mahareeq ..... B01L 3/0224 422/517

FOREIGN PATENT DOCUMENTS

EP 0704242 A2 4/1996

OTHER PUBLICATIONS

Jul. 22, 2014, International Preliminary Report on Patentability from The International Bureau of WIPO, in PCT/EP2013/053835, which is the international application.
Jun. 25, 2013, International Search Report of the International Search Authority from The European Patent Office in PCT/EP2013/053835, which is the international application.

(Continued)

*Primary Examiner* — Paul Hyun
(74) *Attorney, Agent, or Firm* — Kolisch Hartwell, P.C.

(57) ABSTRACT

A dosing device comprises a housing. The housing has a slot-shaped opening in the axial direction. The respective region of a setting cylinder located inside the housing can be seen from the exterior through the opening. The setting cylinder can be radially rotated or set by way of a setting wheel. Quantitative indications of the discharge volumes for various syringe types at various settings are arranged in columns on the setting cylinder in the form of a table. The cylinder is oriented relative to the window in the housing such that at a given angular setting of the cylinder the correct discharge volume is visible in the window for every syringe type.

19 Claims, 3 Drawing Sheets

(56) References Cited

OTHER PUBLICATIONS

Quasar Instruments, LLC, website point of purchase display advertising Quasar Instruments products "Microplates, Repeater Pipettes, Repeater Syringes", Jan. 2012, in Jun. 25, 2013 International Search Report of the International Search Authority from The European Patent Office in PCT/EP2013/053835, and obtained Jun. 13, 2013 and Aug. 20, 2014, at http://www.quasarinstruments.com/c-2638-jan-2012-microplates-repeater-pipettes-repeater-syringes.aspx.

Quasar Instruments, LLC, "Ripette pro The Handy One" product brochure, Jan. 2012, in Jun. 25, 2013 International Search Report of the International Search Authority from The European Patent Office in PCT/EP2013/053835, and obtained Jun. 13, 2013 and Aug. 20, 2014, at http://www.quasarinstruments.com/Images/document/Ritter/Ritter_RipettePRO.pdf.

Ritter Medical Care, "ripette" product brochure, Jan. 2012, in Jun. 25, 2013 International Search Report of the International Search Authority from The European Patent Office in PCT/EP2013/053835, and obtained Jun. 13, 2013 and Aug. 20, 2014, at http://www.quasarinstruments.com/Documents/Ritter/Ritter%20Ripette/020Repeater.pdf.

* cited by examiner

DEVICE WITH DISPLAY FOR REPEATED DOSING

CROSS-REFERENCE TO RELATED APPLICATIONS

This application is a national phase application of PCT/EP2013/053835, filed Feb. 26, 2013, which claims priority to German Patent Application No. 102012102292.5, filed Mar. 19, 2012, each of which is hereby incorporated by reference.

TECHNICAL FIELD

The invention relates to a device (pipette) for dosed dispensing of a medium from a container, which comprises a plunger, by depressing the plunger, comprising: a housing; a dispensing mechanism with a dispensing element; an actuating element which can be moved from a first stop to a second stop, wherein the actuating element is coupled to the dispensing mechanism such that, upon movement of the actuating element from the first stop to the second stop, the dispensing element depresses the plunger by a distance; and a setting mechanism for setting the distance travelled by the dispensing element for every movement of the actuating element from the first stop to the second stop, wherein the setting mechanism can be set in steps by rotation of a setting element and has at least a cylindrical wall section.

PRIOR ART

In laboratory applications, especially, it happens that serial dosing with a predetermined volume (e.g. 1 μl-5 ml) must be performed. The manual dispensing of a plurality of smaller quantities from a syringe without the use of aids is not only difficult, but also error-prone. For this reason, aids, e.g. hand-held dispensers, were developed which make it possible to perform series dosing by presetting the volume to be dispensed. The desired dispensing volume per actuation cycle is pre-set by a setting mechanism.

Prior to dosing, a syringe is inserted into the device and a specific volume of the fluid is drawn up into the syringe. Then, the actuating element is repeatedly actuated until serial dosing has been completed or until the syringe has been emptied.

To reduce the number of auxiliary equipment in the laboratory, most hand-held dispensers are designed so that syringes of various sizes and of different construction can be inserted into the instrument for the purpose of dosing. However, if that increases the versatility of using the device on one hand, the problem arises on the other that it makes it more difficult to set the desired dosing volume, since the plungers of different types of syringes must be depressed by different distances to deliver a specific dosing volume. The desired distance per actuating cycle for a given dosing volume depends in particular on the cross-section of the syringe body.

To find the appropriate setting in each case, guide tables are used that specify the correct setting step of the setting mechanism for various known types of syringes and dispensing volumes per actuation cycle. Even if this approach clearly specifies which step of the setting mechanism is to be selected for a particular type of syringe and dosing volume, there is a significant risk of incorrect settings. For example, it can inadvertently happen that even trained personnel fail to read the correct value from the table, but rather e.g., read a value from an adjacent column on the row. In this way, it can turn out that an entire dosing series is flawed.

OBJECT OF THE INVENTION

Proceeding therefrom, the object of the invention is to provide a device for dosed dispensing of a fluid from a syringe that reduces the susceptibility to errors for the setting of the dosing quantity to be dispensed.

TECHNICAL SOLUTION

This object is achieved by a device for dosed dispensing of a medium from a container, which comprises a plunger, especially from a syringe, in accordance with claim 1. Advantageous embodiments result from the characteristics of the dependent claims.

The device for dosed dispensing of a medium from a container, which comprises a plunger, by depressing the plunger, comprises: a housing; a dispensing mechanism with a dispensing element; an actuating element which can be moved from a first stop to a second stop, wherein the actuating element is coupled to the dispensing mechanism such that, upon movement of the actuating element from the first stop to the second stop, the dispensing element depresses the plunger by a distance; and a setting mechanism for setting the distance travelled by the dispensing element for every movement of the actuating element from the first stop to the second stop, wherein the setting mechanism can be set in steps by rotation of a setting element and has at least a cylindrical wall section. The device further comprises a display element, having a slot-shaped opening in the housing through which a slot-shaped portion of the cylindrical wall section can be seen from outside the housing; and a tabular list of the respective quantities that are dispensed upon movement of the actuating element from the first stop to the second stop for a predetermined number of different types of syringes at various step-like settings of the setting mechanism, wherein the tabular list is arranged on the cylindrical wall section.

The device is a so-called hand-held dispenser or a pipette for dispensing serial doses, e.g. in the volume range between 1 μl and 5 ml. Through actuation of an actuating element, e.g. a push button, the plunger of the syringe is depressed by a distance corresponding to the desired dosing volume per actuation or actuation cycle. This process is repeated until the syringe is empty or until the serial dosing is complete.

The actuating element is coupled to the dispensing mechanism, which comprises a dispensing element that co-operates directly with the syringe plunger, such that, upon full depression of the actuating element from a first stop to a second stop, the dispensing element is moved precisely by the correct, pre-set plunger stroke.

In order that the correct volume may be set, the inventive device has a setting mechanism. In the context of the invention, the setting mechanism has a setting element by way of which a cylindrical wall section, especially a sleeve and/or setting cylinder, can be adjusted, especially step-wise, and relative to the housing, between different radial settings. This setting determines the translation between the actuator travel of the actuating element and the movement distance of the dispensing element. The dispensing mechanism can moreover have a latch which, after the actuating element has been moved over a certain distance, engages with corresponding counter-toothing of the dispensing element. The actuating element is arranged in an axial direction relative to the setting cylinder; the setting cylinder is arranged so as to be axially immovable relative to the housing. To an extent depending on the angular position of the setting cylinder, the latch coupled to the actuating element is blocked for a distance prior to engagement with the counter-toothing of the dispensing element until the latch is moved along the inner wall of the sleeve. At the lower edge of the sleeve, that is, after a certain distance has been travelled by the actuating element, the latch engages under the action of a force (e.g., generated by an elastic element) with counter-toothing. To an extent depending on the angular position of the setting mechanism and/or the setting cylinder, the latch thus enters sooner or later into engagement with the counter-toothing. Since the counter-toothing is part of the substantially rigid dispensing element, the latch pushes the dispensing element down as far as the stop of the actuating element at the second stop. Then, the actuating element and the latch move under the influence of a restoring force (e.g., a spring) back to the first stop and into the starting position. The latch is configured such that it disengages from the counter-toothing while returning to the first stop, thereby leaving said counter-toothing in its position corresponding to the second stop. The latch thus moves back into its starting position in the setting cylinder. The actuation cycle is now repeated until the serial dosing process complete.

According to the invention, the housing has, relative to the setting cylinder, an axial, slot-shaped recess and/or opening, and/or window. The column of the table arranged in the region of the opening can be seen through this opening from the outside. At different angular positions of the setting cylinder, different columns of the table can be seen, such that the dosing quantity for each type of syringe can be read in a simple manner and with reduced susceptibility to errors.

The columns of the tabular list can each specify the dispensed quantity per actuation of the actuating element for the different types of syringes at the particular setting of the setting mechanism, while the rows can specify the dispensed quantity for a particular type of syringe at the various step-like settings of the setting mechanism.

The slot-shaped opening is especially arranged relative to the cylindrical wall section such that, for a given setting step of the setting mechanism, the appropriate dispensed quantity per actuation of the actuating element can be seen for each type of syringe.

Preferably, information on the various types of syringes and/or information on the properties of the various types of syringes is arranged near the slot-shaped opening at the outer wall of the housing.

The setting mechanism preferably comprises a latch and a counter-toothing, e.g. a rack, wherein, at various settings of the setting mechanism, said latch engages between the stops with the counter-toothing after various movement distances of the actuating element.

The setting mechanism can especially comprise a blocking element, which blocks the engagement of the latch with the counter-toothing until the actuating element is depressed downwards by a certain movement distance, wherein the movement distance depends on the setting of the setting mechanism.

Especially, the housing has a receptacle for attaching a syringe to the housing.

The device can further comprise a locking mechanism for fastening the plunger to the dispensing element.

The device can have a filling element having an actuating slider for filling the syringe. Thus, the plunger can be withdrawn from the syringe body and the syringe thereby filled up before serial dosing begins.

The filling element and the locking mechanism are especially coupled.

Preferably, the device has a restoring mechanism which exerts a (restoring) force on the actuating element in the direction of the first stop.

BRIEF DESCRIPTION OF THE DRAWINGS

Further features and advantages of the invention are apparent from the description of preferred an embodiment according to the drawings.

DESCRIPTION OF A PREFERRED EMBODIMENT

Figure 1:
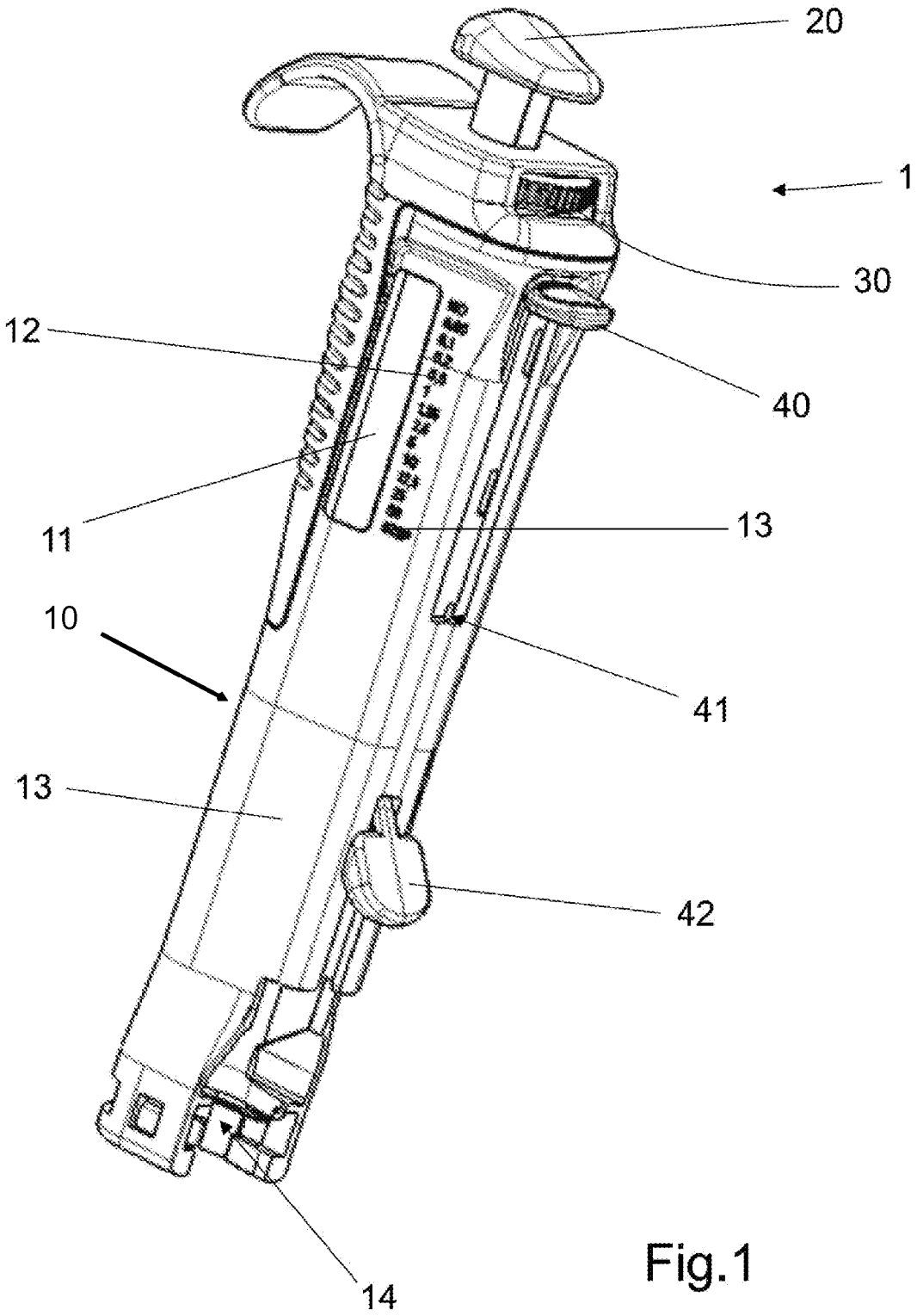
FIG. 1 is a perspective view of a dosing device in accordance with one embodiment of the invention.

FIG. 1 shows a dosing device 1 in accordance with the present invention. The dosing device 1 has a housing 10. The housing 10 has a slot-shaped opening 11 in the axial direction. The respective region of a setting cylinder located inside the housing 10 can be seen from outside the housing 10 through the opening 11. Near the opening 11 and in a block 12 at the same height as the opening 11 are provided rows of information on the various types of syringes, which are identified by their volumes. "Stepp" is displayed in the bottom row 13 of the block because the setting step of a step-like setting mechanism is displayed in the last row of the column of a table displayed in the opening 11.

The respective dosing quantities for the different types of syringes for a given setting step are displayed in the remaining rows.

The dosing device 1 also has an actuating button 20 which, from a first stop position (top, as shown in FIG. 1) into which it is forced by a return spring, can be depressed downwards into a second stop position by actuation. This simple actuation corresponds to single dosing in the context of serial dosing.

Furthermore, the dosing device 1 has a setting wheel 30 by way of which the volume to be dispensed in a single dose can be set. By way of a slider 40, which can be moved from a lower position 41 into the illustrated upper position 40, the syringe, which was introduced into a receptacle 14 of the housing 10, can be filled up. The button 42 is provided for the purpose of actuating a locking mechanism with which the plunger or piston of the syringe can be fastened to a corresponding dispensing element.

Figure 2:
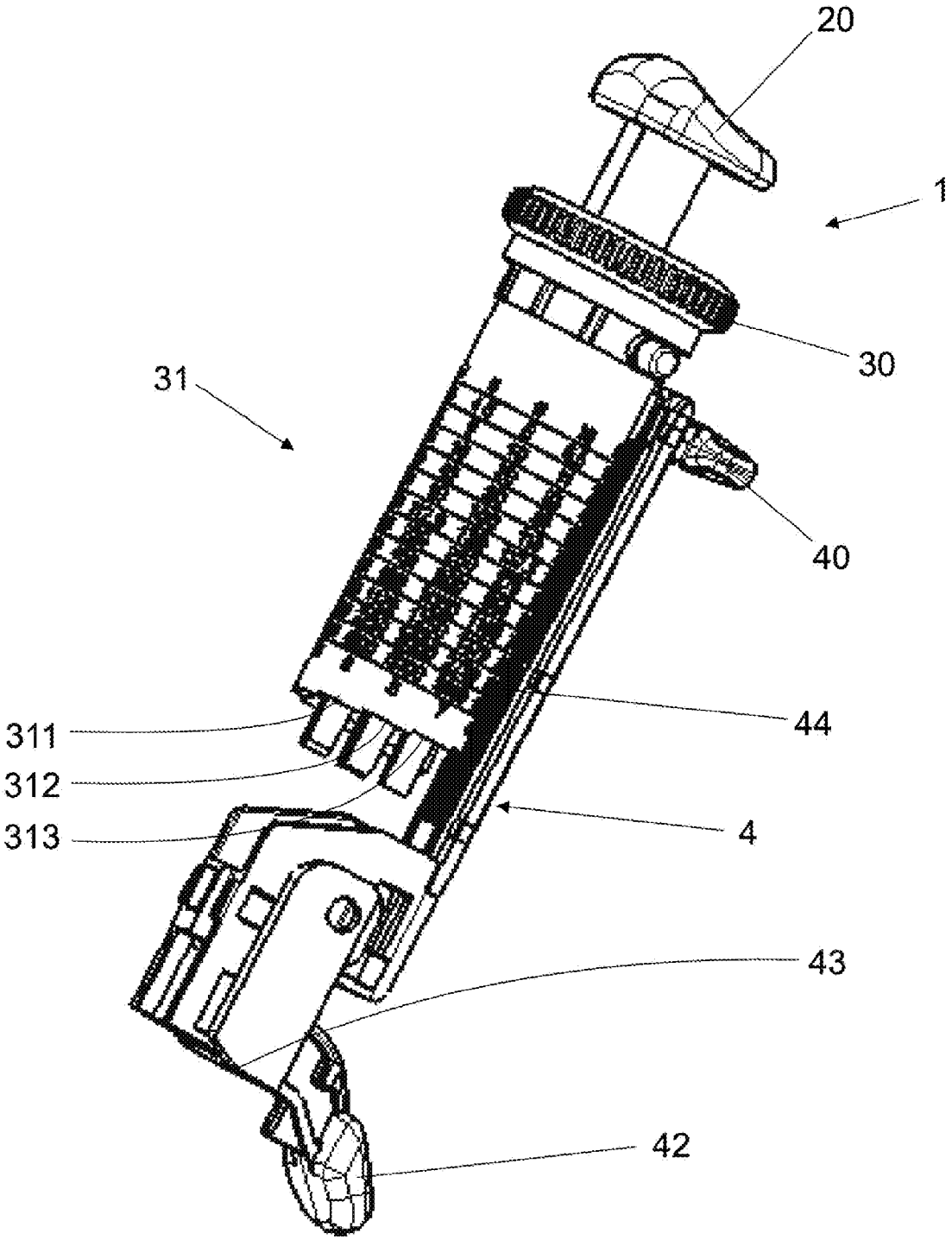
FIG. 2 is a view of individual components of the dosing device in accordance with the invention.

FIG. 2 shows the dosing device 1 without housing. The dispensing mechanism has a dispensing element 4 with the following elements, which are rigidly connected to one another: the above-mentioned slider 40 serves to move the dispensing element 4 from a first position (corresponding to reference numeral 41 in FIG. 1) to a second position (corresponding to reference numeral 40 of FIG. 1) in which the syringe is filled up. The plunger or piston of the syringe (not shown) can be fastened to the dispensing element 4 by way of a locking mechanism 43 such that it can be locked and unlocked. The locking mechanism 43 can be actuated by the locking button 42. The dispensing element 4 also has a rack 44 with which a corresponding latch of the dispensing mechanism can engage, as will be described in connection with FIG. 3.

A central element of the invention is a setting cylinder 31 which is axially fixed relative to the housing. The setting cylinder can be radially rotated or set by way of a setting wheel 30. Quantitative indications of the dispensing volumes for various types of syringe at various settings are arranged in columns on the setting cylinder 31 in the form of a table (the setting step is indicated in the last row).

The cylinder 31 is oriented relative to the window 11 in the housing 10 such that, at a given angular setting of the cylinder 31, the correct dispensing volume can be seen in the window 11 for every type of syringe. To an extent depending on the angular setting of the cylinder 31, the dispensing volumes for a specific type of syringe are displayed in the rows.

The lower edge of the setting cylinder has steps 311, 312, 313, etc., of different axial height. To an extent depending on the angular position at which the cylinder 31 is set, a specific step of the lower edge of the setting cylinder 31 is facing the rack 44. Upon depression of the actuating element 20, a latch, initially at the inner wall of the setting cylinder 31, also moves downwards. To an extent depending on the axial height of the instantaneous setting of the angular position and thus step (e.g., 311, 312, 313, etc.), this latch will now sooner or later engage with the rack 44 and push the dispensing element 4 down into the remaining distance traversed by the actuating element 20 as far as the second stop. Thus, a piston rod coupled to the dispensing element 4 is also pushed downwards by this distance until the desired volume has been dispensed.

Figure 3:
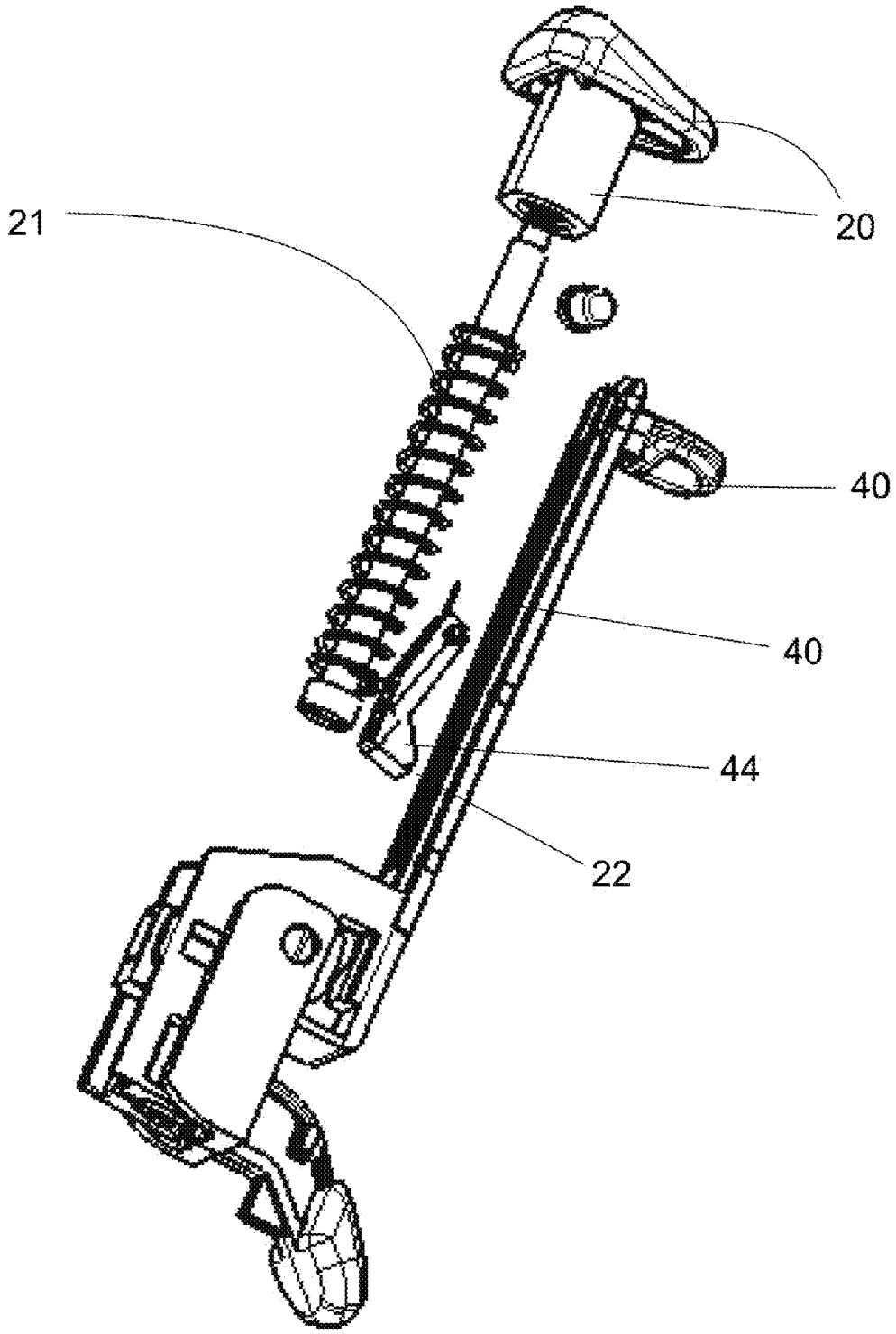
FIG. 3 is a view of further components of the dosing device in accordance with the invention.

Then the actuating element 20 is moved upwards again, as is especially apparent from FIG. 3, under the force of a return spring 21 and back into the starting position at the first stop. During this movement, the latch 22 is not engaged with the rack 44, but rather, due to its geometry, slides over the teeth of the rack 44. The latch 22 then slides back into the setting cylinder 31. Upon the next depressing of the actuating element 20 and latch 22, the latch 22 first moves along the inner side of the setting cylinder 31 as far as the set lower edge of the setting cylinder 31, and then engages, because a force K is acting in the direction of the rack 44 (e.g. a spring force K), with the rack 44 and in turn pushes this downwards through a defined distance.

An embodiment of a dosing device (1) according to the invention comprises a housing (10). The housing (10) has a slot-shaped opening (11) in the axial direction. The respective region of a setting cylinder located inside the housing (10) can be seen from the exterior through the opening (11). The setting cylinder can be radially rotated or set by way of a setting wheel (30). Quantitative indications of the discharge volumes for various syringe types at various settings are arranged in columns on the setting cylinder in the form of a table. The cylinder is oriented relative to the window (11) in the housing (10) such that at a given angular setting of the cylinder the correct discharge volume is visible in the window (11) for every syringe type.

The present disclosure may include one or more of the following concepts:

A. Device (1) for dosed dispensing of a medium from a container, which comprises a plunger, by depressing the plunger, and comprising: a housing (10); a dispensing mechanism with a dispensing element (4); an actuating element (20), which can be moved from a first stop to a second stop, wherein the actuating element (20) is coupled to the dispensing element (4), such that, upon movement of the actuating element (20) from the first stop to the second stop, the dispensing element (4) depresses the plunger by a distance; and a setting mechanism (30, 31) for setting the distance travelled by the dispensing element (4) for every movement of the actuating element (20) from the first stop to the second stop, wherein the setting mechanism can be set in steps by rotation of a setting element (30) and has at least a cylindrical wall section (31); characterised by the fact that the device comprises a display element, comprising: a slot-shaped opening (11) in the housing (10) through which a slot-shaped portion of the cylindrical wall section (31) can be seen from outside the housing (10); and a tabular list of the quantities that are dispensed upon movement of the actuating element (20) from the first stop to the second stop for a predetermined number of different types of syringes at various step-like settings of the setting mechanism (30, 31), wherein the tabular list is arranged on the cylindrical wall section.

B. Device in accordance with paragraph A, characterised by the fact that the columns of the tabular list each specify the dispensed quantity per actuation of the actuating element (20) for the different types of syringes at the particular setting of the setting mechanism, while the rows specify the dispensed quantity for a particular type of syringe at the various step-like settings of the setting mechanism (30, 31).

C. Device in accordance with paragraphs A or B, characterised by the fact that the slot-shaped opening (11) is arranged relative to the cylindrical wall section (31) such that, for a given setting step of the setting mechanism (30, 31), the corresponding dispensed quantity per actuation of the actuating element (20) can be seen for each type of syringe.

D. Device in accordance with any of the previous paragraphs, characterised by the fact that information (12) on the various types of syringes and/or information on the properties of the various types of syringes is located near the slot-shaped opening (11) at the housing.

E. Device in accordance with any of the previous paragraphs, characterised by the fact that the setting mechanism comprises a latch (22) and a counter-toothing (44) wherein, at various settings of the setting mechanism (30, 31), said latch (22) engages between the stops with the counter-toothing (44) after various movement distances by the actuating element (20).

F. Device in accordance with paragraph E, characterised by the fact that the setting mechanism comprises a blocking element (31), which blocks the engagement of the latch (22) with the counter-toothing (44) until the actuating element (20) is depressed downwards by a certain movement distance, wherein the movement distance depends on the setting of the setting mechanism (30, 31).

G. Device in accordance with any of the previous paragraphs, characterised by the fact that the housing (10) has a receptacle (14) for attaching a syringe to the housing (10).

H. Device in accordance with any of the previous paragraphs, characterised by the fact that the device comprises a locking mechanism (42, 43) for fastening the plunger to the dispensing element (4).

I. Device in accordance with any of the previous paragraphs, characterised by the fact that the apparatus comprises a filling element having an actuating slider (40) for filling the syringe.

J. Device in accordance with paragraph I, characterised by the fact that the filling element and the locking mechanism (42, 43) are coupled.

K. Device in accordance with any of the previous paragraphs, characterised by the fact that the device has a restoring mechanism (21) which exerts a force on the actuating element (20) in the direction of the first stop.

L. Device (1) for dosed dispensing of a medium from a container, which comprises a plunger, by depressing the plunger, and comprising: a housing (10); a dispensing mechanism with a dispensing element (4); an actuating element (20), which can be moved from a first stop to a second stop, wherein the actuating element (20) is coupled to the dispensing element (4), such that, upon movement of the actuating element (20) from the first stop to the second stop, the dispensing element (4) depresses the plunger by a distance; and a setting mechanism (30, 31) for setting the distance travelled by the dispensing element (4) for every movement of the actuating element (20) from the first stop to the second stop, wherein the setting mechanism can be set in steps by rotation of a setting element (30) and has at least a cylindrical wall section (31); characterised by the fact that the device comprises a display element, comprising: a slot-shaped opening (11) in the housing (10) through which a slot-shaped portion of the cylindrical wall section (31) can be seen from outside the housing (10); and a tabular list of the quantities that are dispensed upon movement of the actuating element (20) from the first stop to the second stop for a predetermined number of different types of syringes at various step-like settings of the setting mechanism (30, 31), wherein the tabular list is arranged on the cylindrical wall section, wherein the columns of the tabular list each specify the dispensed quantity per actuation of the actuating element (20) for the different types of syringes at the particular setting of the setting mechanism, while the rows specify the dispensed quantity for a particular type of syringe at the various step-like settings of the setting mechanism (30, 31), the slot-shaped opening (11) is arranged relative to the cylindrical wall section (31) such that, for a given setting step of the setting mechanism (30, 31), the corresponding dispensed quantity per actuation of the actuating element (20) can be seen for each type of syringe, and information (12) on the various types of syringes and/or information on the properties of the various types of syringes is located beside the slot-shaped opening (11) at the housing.

M. Device in accordance with any of the previous paragraphs, characterised by the fact that the setting mechanism comprises a latch (22) and a counter-toothing (44) wherein, at various settings of the setting mechanism (30, 31), said latch (22) engages between the stops with the counter-toothing (44) after various movement distances by the actuating element (20).

N. Device in accordance with paragraph M, characterised by the fact that the setting mechanism comprises a blocking element (31), which blocks the engagement of the latch (22) with the counter-toothing (44) until the actuating element (20) is depressed downwards by a certain movement distance, wherein the movement distance depends on the setting of the setting mechanism (30, 31).

O. Device in accordance with any of the previous paragraphs, characterised by the fact that the housing (10) has a receptacle (14) for attaching a syringe to the housing (10).

P. Device in accordance with any of the previous paragraphs, characterised by the fact that the device comprises a locking mechanism (42, 43) for fastening the plunger to the dispensing element (4).

Q. Device in accordance with any of the previous paragraphs, characterised by the fact that the apparatus comprises a filling element having an actuating slider (40) for filling the syringe.

R. Device in accordance with paragraph Q, characterised by the fact that the filling element and the locking mechanism (42, 43) are coupled.

S. Device in accordance with any of the previous paragraphs, characterised by the fact that the device has a restoring mechanism (21) which exerts a force on the actuating element (20) in the direction of the first stop.

What is claimed is:

1. A device for dosed dispensing of a medium from a container, which comprises a plunger, by depressing the plunger, and comprising:

a housing;

a dispensing mechanism with a dispensing element;

an actuating element, which can be moved from a first stop to a second stop, wherein the actuating element is coupled to the dispensing element, such that, upon movement of the actuating element from the first stop to the second stop, the dispensing element depresses the plunger by a distance;

a setting mechanism adapted to set the distance travelled by the dispensing element for every movement of the actuating element from the first stop to the second stop, wherein the setting mechanism can be set in steps by rotation of a setting element and has at least a cylindrical wall section; and a display element that includes:

a slot-shaped opening in the housing through which a slot-shaped portion of the cylindrical wall section can be seen from outside the housing, wherein the slot-shaped opening is arranged relative to the cylindrical wall section such that, for a given setting step of the setting mechanism, a corresponding dispensed quantity per actuation of the actuating element can be seen for each type of container, and information on one or more container types or information on one or more properties of the one or more container types is located beside the slot-shaped opening at the housing; and a tabular list of one or more quantities that are dispensed upon movement of the actuating element from the first stop to the second stop for a predetermined number of different types of containers at various step-like settings of the setting mechanism, wherein the tabular list is arranged on the cylindrical wall section, one or more columns of the tabular list each specify the dispensed quantity per actuation of the actuating element for the different types of containers at a particular setting of the setting mechanism, and one or more rows of the tabular list specify the dispensed quantity for a particular type of container at the various step-like settings of the setting mechanism.

2. The device according to claim 1, wherein the setting mechanism comprises a latch and a counter-toothing, wherein, at various settings of the setting mechanism, said latch engages between the first and second stops with the counter-toothing after various movement distances by the actuating element.

3. The device according to claim 2, wherein the setting mechanism comprises a blocking element, which blocks the engagement of the latch with the counter-toothing until the actuating element is depressed downwards by a certain movement distance, wherein the certain movement distance depends on the setting of the setting mechanism.

4. The device according to claim 3, wherein the housing has a receptacle adapted to attach a container to the housing.

5. The device according to claim 4, wherein the device comprises a locking mechanism adapted to fasten the plunger to the dispensing element.

6. The device according to claim 5, wherein the device has a filling element having an actuating slider adapted to fill the container.

7. The device according to claim 6, wherein the filling element and the locking mechanism are coupled.

8. The device according to claim 1, wherein the device has a restoring mechanism which exerts a force on the actuating element in a direction of the first stop.

9. The device according to claim 1, wherein the housing has a receptacle for attaching a container to the housing.

10. The device according to claim 1, wherein the device comprises a locking mechanism for fastening the plunger to the dispensing element.

11. The device according to claim 1, wherein the device comprises a filling element having an actuating slider for filling the container.

12. The device according to claim 11, wherein the filling element and the locking mechanism are coupled.

13. The device according to claim 12, wherein the device has a restoring mechanism which exerts a force on the actuating element in a direction of the first stop.

14. A device for dosed dispensing of a medium from a container, which comprises a plunger, by depressing the plunger, and comprising:

a housing;

a dispensing mechanism with a dispensing element;

an actuating element, which can be moved from a first stop to a second stop, wherein the actuating element is coupled to the dispensing element, such that, upon movement of the actuating element from the first stop to the second stop, the dispensing element depresses the plunger by a distance;

a setting mechanism configured for setting the distance travelled by the dispensing element for every movement of the actuating element from the first stop to the second stop, wherein the setting mechanism can be set in steps by rotation of a setting element and has at least a cylindrical wall section; and a display element that includes a slot-shaped opening in the housing through which a slot-shaped portion of the cylindrical wall section can be seen from outside the housing; and a tabular list of one or more quantities that are dispensed upon movement of the actuating element from the first stop to the second stop for a predetermined number of different types of containers at various step-like settings of the setting mechanism, wherein the tabular list is arranged on the cylindrical wall section;

wherein the setting mechanism comprises a latch and a counter-toothinq wherein, at various settings of the setting mechanism, said latch engages between the first and second stops with the counter-toothinq after various movement distances by the actuating element.

15. The device according to claim 14, wherein one or more columns of the tabular list each specify dispensed quantity per actuation of the actuating element for different types of containers at a particular setting of the setting mechanism, and one or more rows of the tabular list specify dispensed quantity for a particular type of container at various step-like settings of the setting mechanism.

16. The device according to claim 14, wherein the slot-shaped opening is arranged relative to the cylindrical wall section such that, for a given setting step of the setting mechanism, the corresponding dispensed quantity per actuation of the actuating element can be seen for each type of container.

17. The device according to claim 16, wherein information on one or more types of containers and/or information on one or more properties of the various types of containers is disposed proximate the slot-shaped opening at the housing.

18. The device according to claim 14, wherein the setting mechanism comprises a blocking element, which blocks the engagement of the latch with the counter-toothing until the actuating element is depressed downwards by a certain movement distance, wherein the movement distance depends on the setting of the setting mechanism.

19. The device according to claim 14, wherein the device comprises a locking mechanism configured for fastening the plunger to the dispensing element, a filling element having an actuating slider configured for filling the container, the filling element and the locking mechanism being coupled, and a restoring mechanism configured to exert a force on the actuating element in the direction of the first stop.

* * * * *